United States Patent [19]

Dixon et al.

[11] Patent Number: 5,013,278

[45] Date of Patent: May 7, 1991

[54] DIORAMA TOY KIT

[75] Inventors: Anthony J. Dixon, Maresfield; Peter R. J. Manning, St. Briavels, both of England

[73] Assignee: Monogram Models, Inc., Morton Grove, Ill.

[21] Appl. No.: 511,224

[22] Filed: Apr. 19, 1990

[51] Int. Cl.[5] ..... A63H 3/00; A63H 3/50

[52] U.S. Cl. ..... 446/73; 446/219; 446/478; 206/45.31

[58] Field of Search ..... 446/73, 72, 75, 219, 446/478, 476, 268; 206/45.31, 45.34, 216; 220/662, 663

[56] References Cited

U.S. PATENT DOCUMENTS

| | | | |
|---|---|---|---|
| 1,236,678 | 8/1917 | Coventry | 446/268 |
| 3,182,420 | 5/1965 | Bender | 446/478 |
| 4,165,579 | 8/1979 | Chase | 446/73 |

FOREIGN PATENT DOCUMENTS

| | | | |
|---|---|---|---|
| 334453 | 5/1920 | Fed. Rep. of Germany | 446/75 |
| 790697 | 2/1958 | United Kingdom | 446/73 |

*Primary Examiner*—Mickey Yu

*Attorney, Agent, or Firm*—Dressler, Goldsmith, Shore, Sutker & Milnamow

[57] ABSTRACT

A miniature toy kit including a three-dimensional diorama scene, figures positionable on the scene and a case which functions both as a supporting field for the toy and a storage and carrying case. The diorama scene is formed of an elastic and memory-retaining material such as latex so that the same may be compressed into the case for storage but springs back to its original three-dimensional form when the case is opened. Different dioramas can be substituted and numbers of kits can be connected in modular fashion. When stored in the case, the figures are safely held against movement and possible injury.

11 Claims, 4 Drawing Sheets

84
85
84
85
80
76
74
13
70
82
78
80
72
48
54
56
48
50
52
50
60
64
66
62
66
68
60
58

FIG. 7
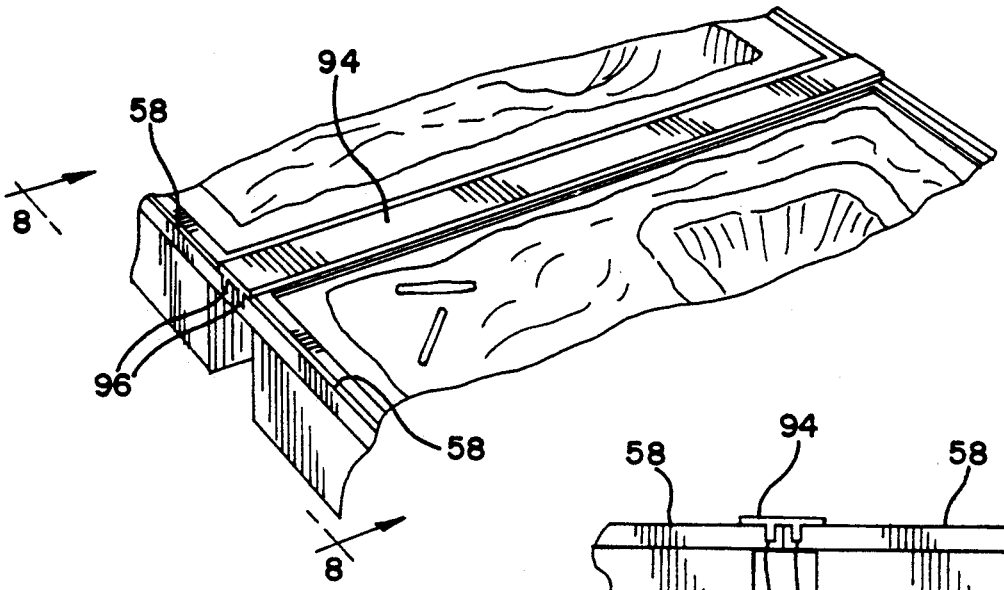
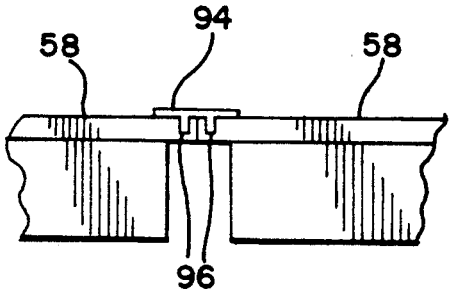
FIG. 8
FIG. 6
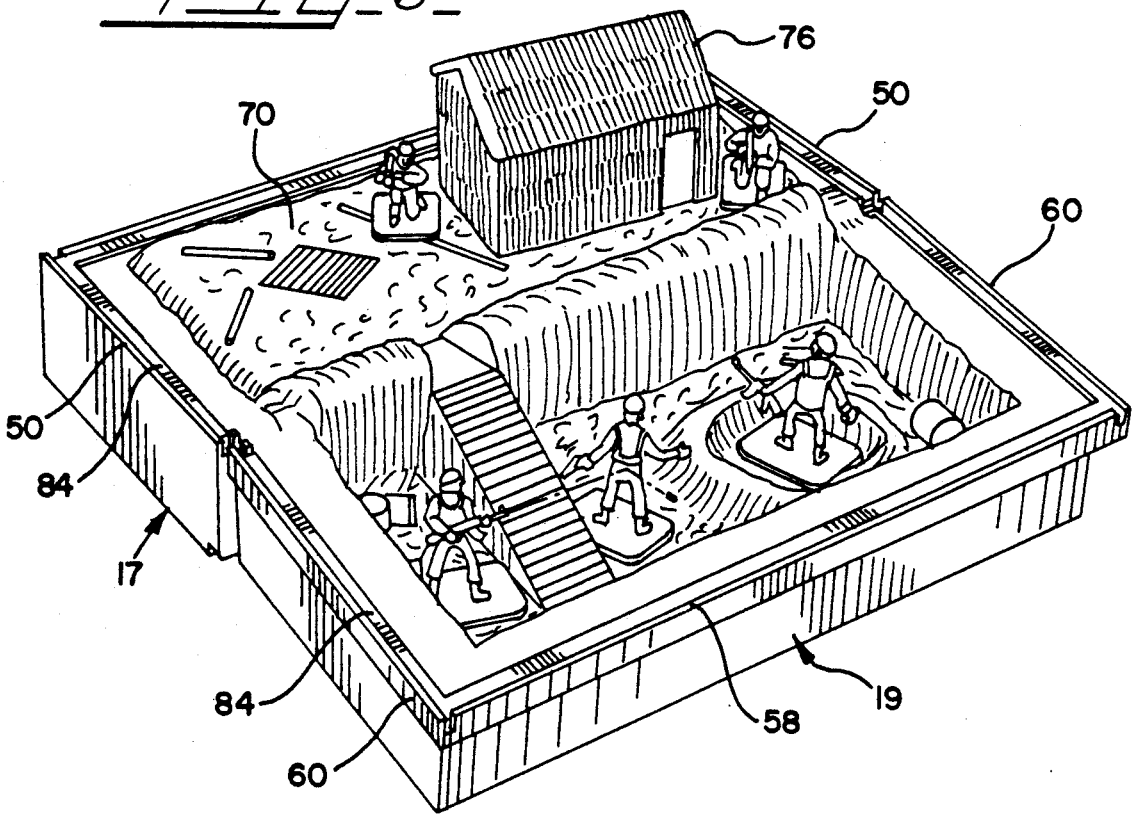

DIORAMA TOY KIT

BACKGROUND OF THE INVENTION

This invention relates to miniature amusement devices and, more particularly, to a self-contained toy kit capable of simulating selected scenes, conditions and events.

Miniature toys which simulate realistic characters and/or objects have ever provided a source of amusement and delight for children and grownups alike. The popularity, for example, of toy soldiers, miniature doll houses, model automobiles, and the like, is well known.

Toy kits comprising a plurality of individual parts or pieces present problems of safe and convenient storage when the toys are not in use. Simple tossing of the individual pieces into a box or similar container is often unacceptable because it may cause damage such as scratching, chipping of paint, tearing or puncturing, or the like, depending on the particular materials of construction.

Other problems encountered with toy kits relate to their portability and the ease with which they may be assembled, disassembled and carried from place to place. Ideally, the kit pieces may be safely stored and transported in the smallest feasible carrying case and the carrying case should itself comprise an element of the assembled toy.

SUMMARY OF THE INVENTION

The present invention provides a toy kit having a realistic setting in the form of a miniature diorama and a plurality of figures or objects positionable as desired on or in the three-dimensional scene. The kit includes a compact carrying case for safely storing and transporting the individual pieces and also functioning as a base or support for the diorama scene.

Briefly, the invention comprises a compact carrying case having a pair of hingedly connected members which, when in the closed storage mode, provide a pair of compartments. Means is provided in one compartment for holding the individual miniature figures or objects. Cooperating locking means is also provided for insuring against unwanted movement of the figures during storage.

The invention comprises further a miniature scene or diorama. The diorama is formed of a flexible but durable material, such as latex, and natural or synthetic rubbers. When the case is closed, the flexible diorama is folded and stored nicely in the second compartment. When it is desired to set up the scene, the second compartment is opened whereupon the resiliency and memory-retaining characteristics of the material of construction cause the diorama to return automatically to its original three-dimensional state. At the same time, the opened case members provide a solid and level base for supporting the diorama so that the figures may be positioned thereon as desired.

The invention also provides a transparent cover for the first compartment permitting observation of the stored figures. The cover includes a magnification area so that the miniature figures may be examined in detail if desired.

According to another feature of the invention, multiple dioramas are connectable in modular arrangement to provide larger and varied scenes.

Numerous other features and advantages of the present invention will become apparent from the following detailed description of the invention, from the claims and from the accompanying drawings.

BRIEF DESCRIPTION OF THE DRAWINGS

In the accompanying drawings forming a part of the specification, and in which like numerals are employed to designate like parts throughout the same.

FIG. 6 is a perspective view showing the diorama kit fully set up;

FIG. 7 is a fragmentary perspective view showing a pair of dioramas in modular connection; and FIG. 8 is a sectional view on the plane of line 8—8 in FIG. 7.

DETAILED DESCRIPTION OF THE INVENTION

Figure 1:
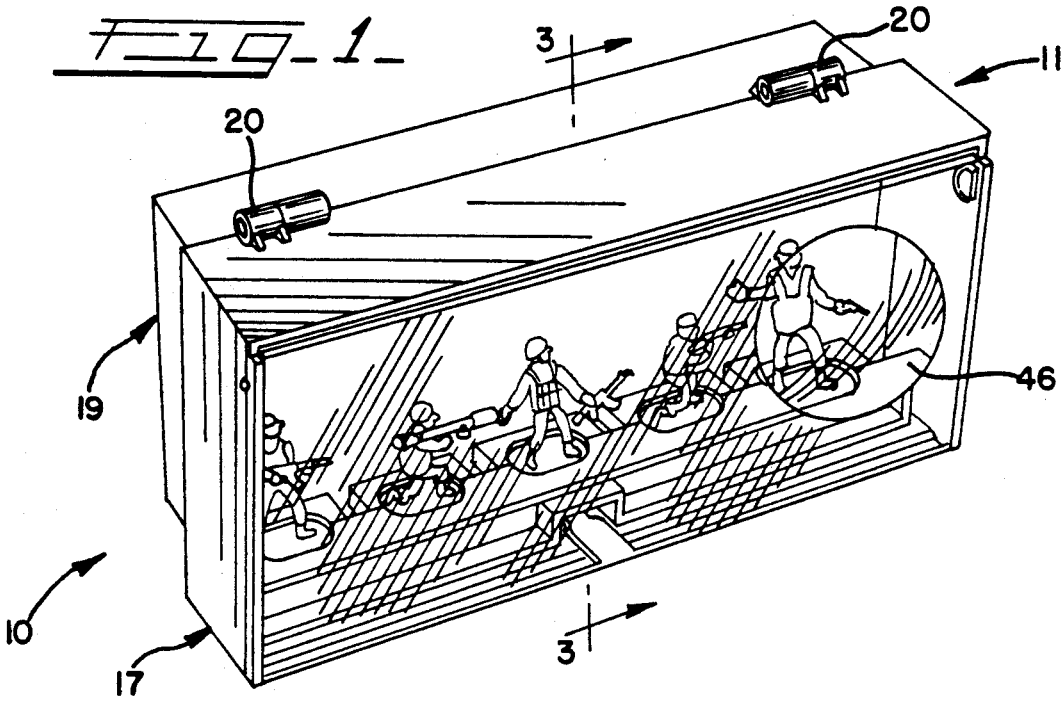
FIG. 1 is a perspective view of a diorama toy kit embodying the principles of the invention and showing the same in the closed storage condition.

Referring with greater particularity to the various figures of the drawings, the reference numeral 10 indicates a diorama toy kit embodying the principles of the invention. Toy kit 10 comprises generally a twocompartment case 11, a diorama 13 and a plurality of miniature FIGS. 15.

Figure 2:
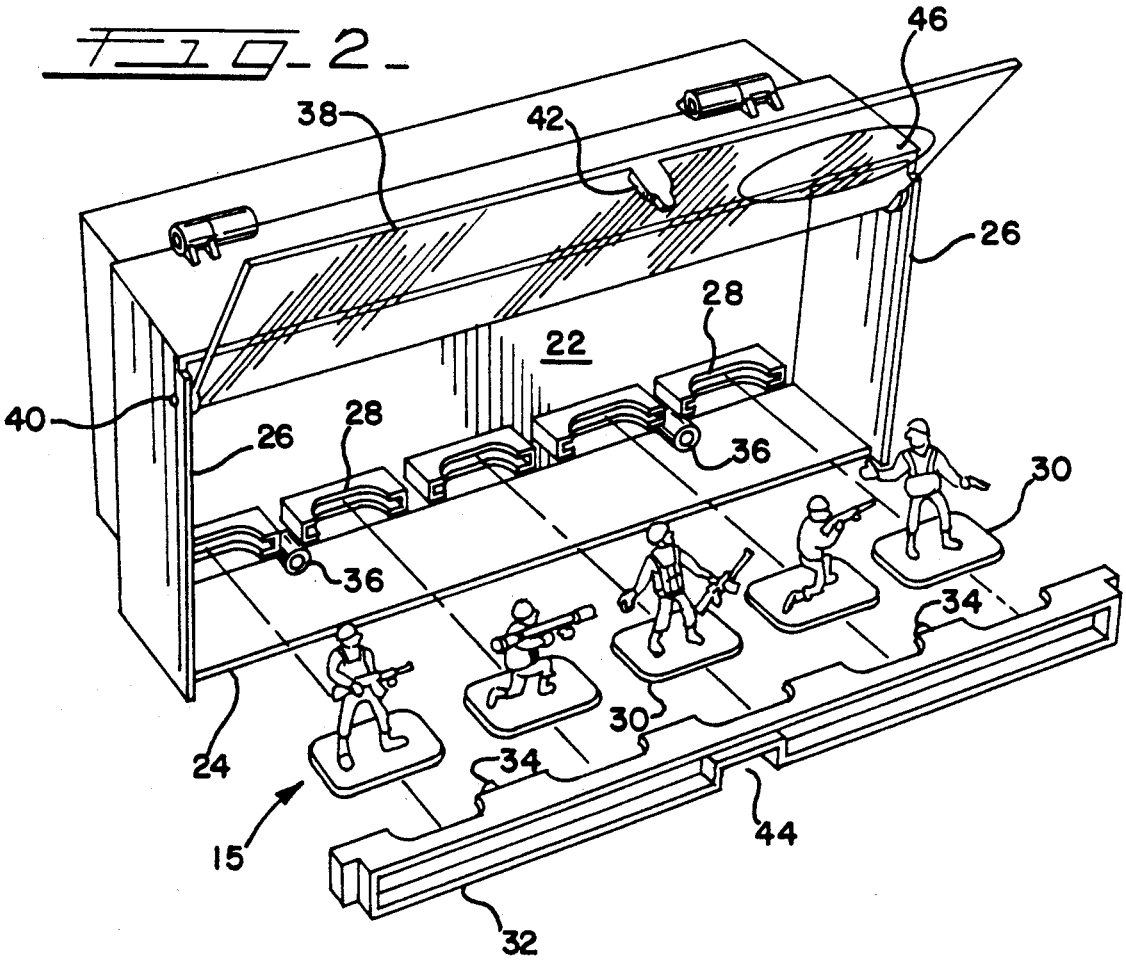
FIG. 2 is a similar view showing the top compartment of the case open with the figures removed.

Case 11 comprises a top compartment 17 and a bottom compartment 19 hingedly connected as at 20. The top compartment 17 comprises a rectangular box having a floor 22, side walls 24, 24, and end walls 26, 26. Projecting integrally from the facing surface of the floor 22 are a plurality of figure holders 28, said holders being adapted to receive therein the pedestals or bases 30 formed on each of the figures 15 (see FIGS. 1, 2 and 3). A figure retaining bar 32 cooperates with the holders 28 to hold the figures in stored condition, and said bar is operationally held by the frictional engagement of pin projections 34 receivable in short tubes 36 projecting from the floor 22.

A transparent cover member 38 is pivotally connected to the end walls 26 by pintles such as 40 for closing the compartment 17 while permitting observation and viewing of the figures stored therein. The cover member 38 carries a finger 42 which is frictionally engageable with a side wall 24 to close the compartment 17, said finger 42 being receivable in a notched opening 44 formed in the retaining bar 32. The cover member 38 preferably is formed with a double convex magnifying area 46 whereby the miniature figure positioned thereunder may be observed in larger detail.

Figure 5:
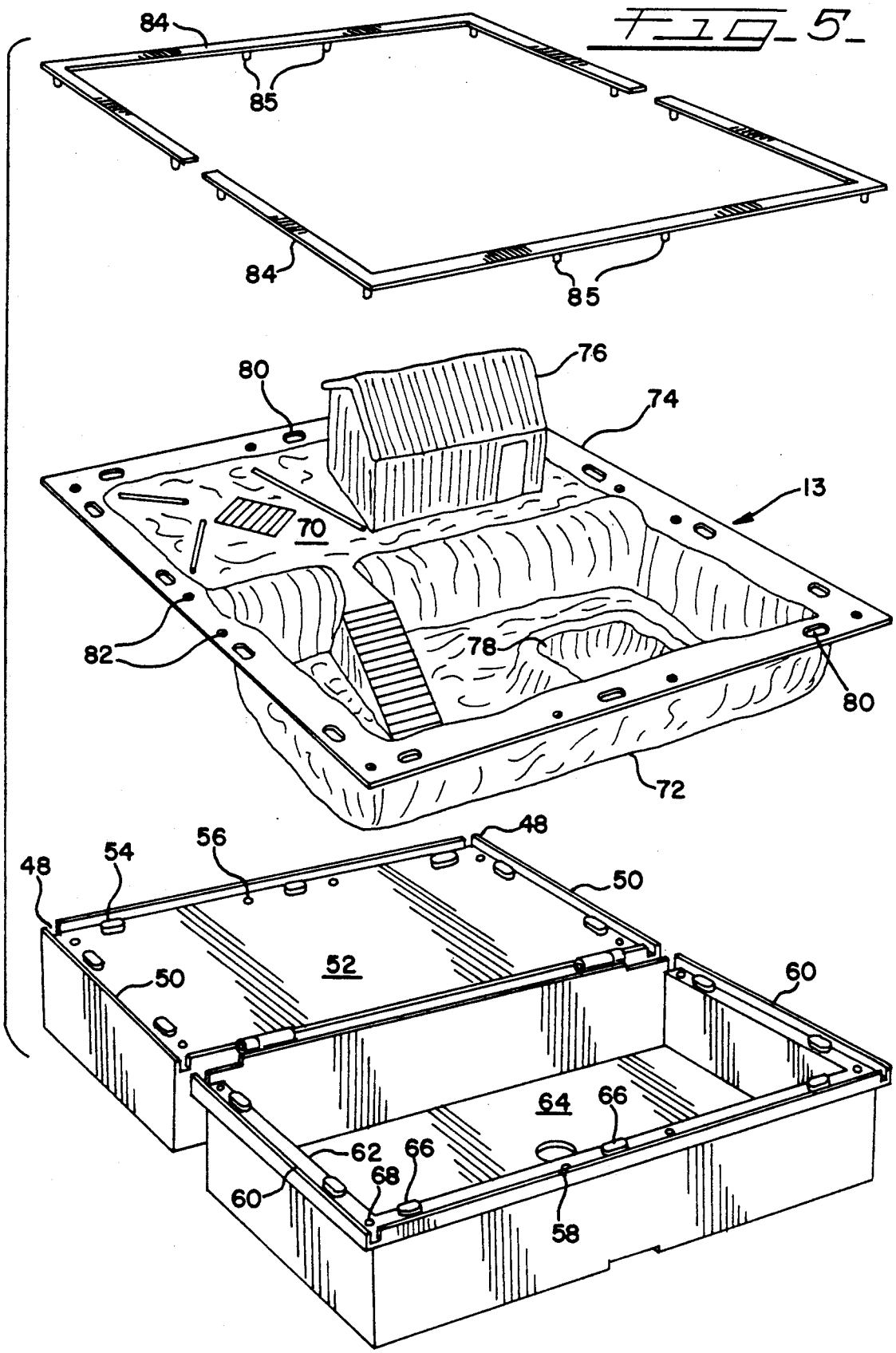
FIG. 5 is an exploded perspective view showing the bottom compartment of the case fully opened and the diorama and its retaining means separated therefrom.

As seen best in FIG. 5, floor 22 is recessed slightly from the rear edges of the side walls 24 and end walls 26 and said side walls comprise end notches 48 so that the rearwardly extending end wall segments provide rims 50 for reasons which will become apparent as the description proceeds. The rear surface 52 of the floor 22 is formed with a plurality of upraised pads 54 and spaced holes 56 whose function will likewise subsequently be described.

The bottom compartment 19 comprises a slightly smaller rectangular box having a top rim defined by side rims 58, 58, and end rims 60, 60, that aligns and mates with the walls and rims of the top compartment 17. Interiorly, the compartment 19 comprises a ledge 62 and a reduced dimension well 64. The ledge 62 is formed with a plurality of upraised pads 66 and spaced holes 68 of similar configuration and arrangement as those provided on the rear surface 52 of the floor of the top compartment. When the case 11 is fully opened and placed on a horizontal supporting surface, the surface 52 and ledge 62 lie in substantially the same plane and provide, in effect, a level supporting table for the diorama and figures.

The diorama 13 comprises an elastic and flexible member having multiple levels such as upper level 70 and lower level 72 and a perimetral flange 74. Various three-dimensional features such as a hut 76 and a fox hole 78 are formed in relief on the diorama 13, the embodiment illustrated thereby simulating a Vietnam War jungle scene. Alignment holes 80 and retainer holes 82 are cut in the flange 74. The diorama comprises a memory-retaining elastomeric material, such as latex and natural or synthetic rubbers, and may be made by well known conventional methods like dip molding and slush molding.

For operationally mounting the diorama 13 in the case 11, the invention comprises a pair of channel-shaped retainers 84 having depending retainer pins 85. To assemble the diorama, the alignment holes 80 are positioned over the pads 54 and 66 and the pins 85 of the retainers then press-fit through the holes 82 and into the holes 56 and 68. When thus assembled, it will be seen that the lower level 72 of the diorama fits within the well 64 while the upper level 70 rests on surface 52.

Figure 4:
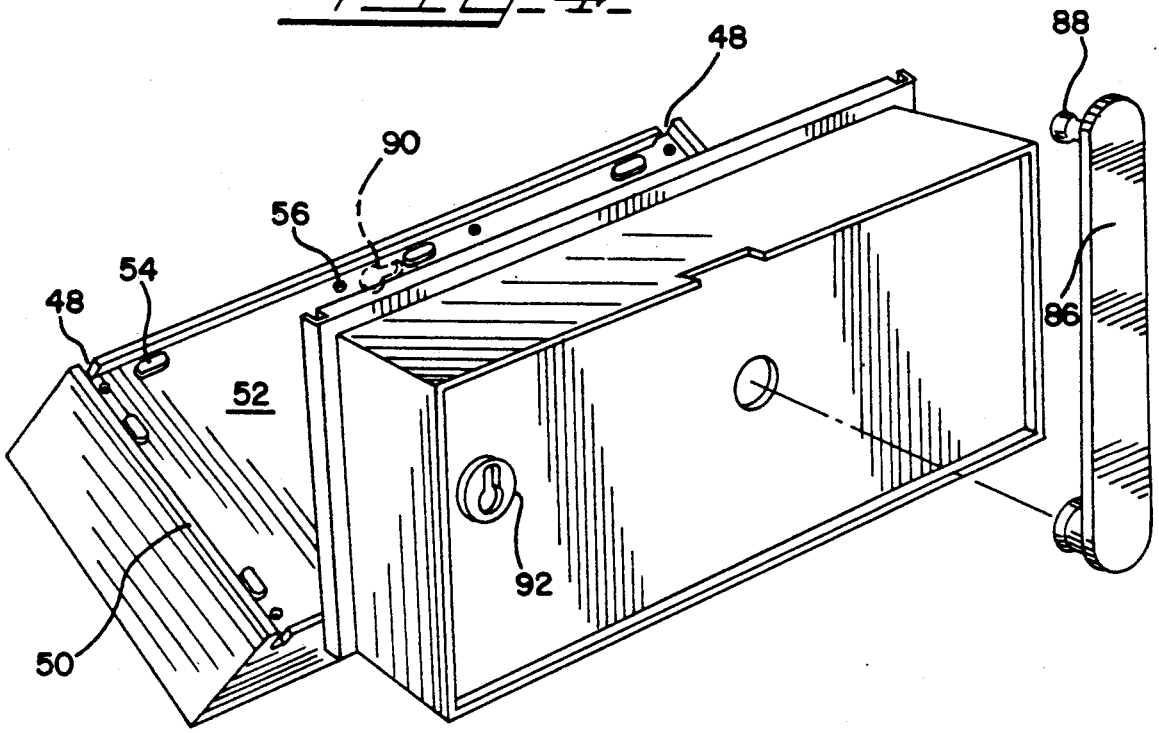
FIG. 4 is a bottom perspective view.
Figure 3:
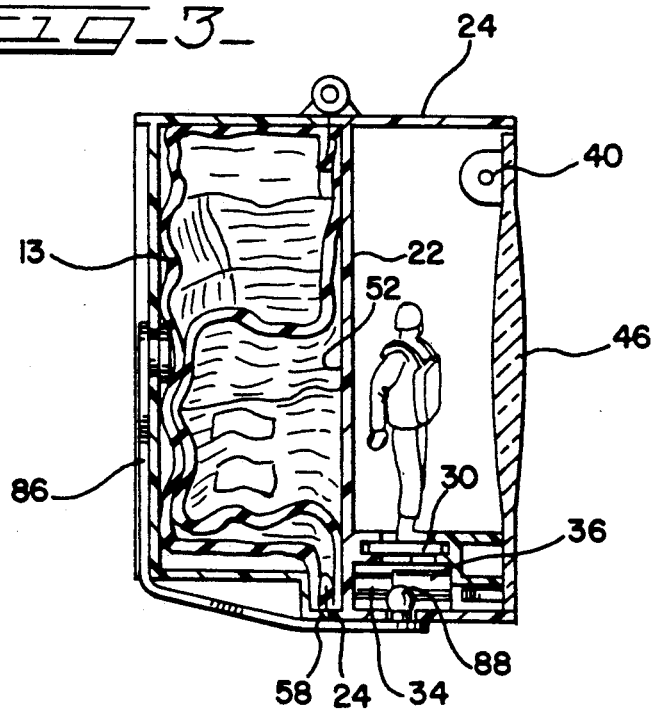
FIG. 3 is a sectional view substantially on the plane of line 3—3 in FIG. 1.

When storage is required, the two case compartments are simply pivoted together to fold or compress and enclose the diorama 13 therein (see FIG. 3). A latching means, such as a flexible strap 86 is provided for latching the kit in the closed storage condition. The strap 86 is pivotally connected and carries a pin 88 selectively cooperable with a slot 90 formed in the side wall 24 of the upper compartment and a similar slot 92 formed in the bottom of the lower compartment (see FIG. 4).

Dioramas depicting other battle scenes, such as a landing beach or a bunker and trench position, may be substituted for the jungle scene here illustrated. If desired, a diorama may be changed in a single case 11 by removing the retainers and positioned diorama and operationally replacing with another. On the other hand, means is provided for modular connection of a number of toy kits 10, said means comprising a connector bar 94 (see FIGS. 7 and 8). Connector bar 94 comprises a pair of depending legs 96, 96, forming a longitudinal channel adapted to frictionally fit over the end rims 50 and 60 of a pair of abutting cases 11.

It should be appreciated that a preferred embodiment of the invention has been described herein for illustrative purposes only and is not intended to be otherwise limiting of the structural concepts of the invention. Thus, for example, other types of diorama scenes and figures may be substituted, such as racing tracks, circuses, cars, horses, other animals, and the like. Other changes and variations may be made by those skilled in the art without departing from the spirit and scope of the invention as defined in the appended claims.

We claim:

1. A miniature toy kit comprising:

a case having a pair of pivotally connected compartments;

a plurality of figures;

means in one of said compartments for storing said figures;

a three-dimensional diorama; and retainer means operationally mounting said diorama in said case with portions thereof positioned in the other of said compartments, said compartments being pivotable between an open condition wherein the same provide a support field for the diorama and figures and a closed condition wherein the same provide a storage case for the diorama and figures, said diorama comprising an elastic member compressible into the case when in the closed condition and springing back to three-dimensional form when the case is in the open condition.

2. A miniature toy kit according to claim 1 wherein said case comprises a top compartment and a bottom compartment, said top compartment comprising a rectangular box having side walls, end walls and a floor, said first-mentioned means being positioned on said floor.

3. A miniature toy kit according to claim 2 wherein each of said figures comprises a base, said first-mentioned means comprising a plurality of holders adapted to receive portions of said figure bases, and a complementary retaining bar frictionally connectable to said holders for securely retaining the figures in stored condition.

4. A miniature toy kit according to claim 3 comprising a cover pivotally connected to said top compartment for closing same, said cover being transparent whereby the stored figures are visible therethrough.

5. A miniature toy kit according to claim 4 wherein said cover comprises a magnification area whereby a stored figure positioned thereunder is visibly magnified.

6. A miniature toy kit according to claim 2 comprising latching means on said top and bottom compartments for latching said compartments in the closed condition.

7. A miniature toy kit according to claim 2 wherein said bottom compartment comprises a rectangular rim of complementary configuration with the walls of said top compartment, an inwardly extending ledge and a well for supporting portions of the operationally mounted diorama when the case is in the open condition and for containing the compressed diorama when the case is in the closed condition.

8. A miniature toy kit according to claim 7 wherein said retainer means comprises a pair of channel-shaped retainers having depending retainer pins, said retainer pins adapted to pass through holes in border portions of the diorama and being frictionally engageable in retainer holes formed in said ledge and floor.

9. A miniature toy kit according to claim 8 wherein said ledge and the bottom surface of said floor comprise a substantially planar support surface when the case is in the open condition.

10. A miniature toy kit according to claim 9 comprising connector means for connecting a pair of said open condition cases in modular relationship.

11. A miniature toy kit according to claim 10 wherein said connector means comprises a bar having a pair of depending legs forming a longitudinal channel, said channel being frictionally engageable over the rims and portions of the top compartment end walls of a pair of abutting open condition cases.

* * * * *